United States Patent [19]

Zimmerman

[11] 4,283,203

[45] Aug. 11, 1981

[54] PETROLEUM FUEL COMPOSITION CONTAINING AN ANTI-HAZE ADDITIVE

[75] Inventor: Abraham A. Zimmerman, Summit, N.J.

[73] Assignee: Exxon Research & Engineering Co., Florham Park, N.J.

[21] Appl. No.: 137,423

[22] Filed: Apr. 4, 1980

Related U.S. Application Data

[63] Continuation of Ser. No. 886,721, Mar. 15, 1978, abandoned.

[51] Int. Cl.[3] ..... C10L 1/18

[52] U.S. Cl. ..... 44/62; 44/68; 44/69

[58] Field of Search ..... 44/55, 62, 68, 69; 252/380

[56] References Cited

U.S. PATENT DOCUMENTS

| | | | |
|---|---|---|---|
| 2,013,152 | 9/1935 | Hoyt | 44/51 |
| 2,692,821 | 10/1954 | Ambrose et al. . | |
| 2,982,750 | 5/1961 | Cyba et al. . | |
| 3,336,123 | 8/1967 | Dudley . | |
| 3,667,152 | 6/1972 | Eckert . | |
| 3,834,882 | 9/1974 | Barth . | |
| 4,002,558 | 1/1977 | Feldman . | |
| 4,046,521 | 9/1977 | Bessler et al. . | |
| 4,069,162 | 1/1978 | Gardener et al. . | |

FOREIGN PATENT DOCUMENTS

| | | |
|---|---|---|
| 824555 | 12/1959 | United Kingdom . |
| 1061161 | 3/1967 | United Kingdom . |

*Primary Examiner*—Winston A. Douglas
*Assistant Examiner*—J. V. Howard
*Attorney, Agent, or Firm*—Eugene Zagarella, Jr.

[57] ABSTRACT

This invention relates to petroleum fuel compositions with improved haze properties, said fuel composition containing an anti-haze additive comprising an hydroxylated resin acid and/or a selected metal resinate salt.

25 Claims, No Drawings

PETROLEUM FUEL COMPOSITION CONTAINING AN ANTI-HAZE ADDITIVE

This is a continuation of application Ser. No. 886,721, filed Mar. 15, 1978 and now abandoned.

BACKGROUND OF THE INVENTION

This invention concerns anti-haze or dehaze additives for petroleum fuels.

Petroleum fuels, such as gasoline and jet fuel often encounter haze problems, which result from the formation of a water-in-oil emulsion when only slight traces of water remain in the fuel. This is particularly true when dispersant-detergent additives are added to the fuel. Such dispersant-detergent additives maintain a cleaner carburetor as well as cleaner manifold ports and valves, however, because of the detergent nature of these additives, water tolerance problems have arisen.

One technique known to alleviate the undesirable haze problem in petroleum fuels includes the addition of a solution of inorganic halide or nitrate salts in a solvent such as aliphatic alcohols or glycol ethers as disclosed in U.S. Pat. No. 4,002,558 issued Jan. 11, 1977 to N. Feldman. Another technique involves addition of a dehazing additive comprising phenolformaldehyde resins which are first reacted with α-olefin epoxides and then reacted with an alkylene oxide as disclosed in U.S. Pat. No. 4,046,521 issued Sept. 6, 1977 to D. U. Bessler et al.

SUMMARY OF THE INVENTION

Now it has been discovered that the problem of haze formation in petroleum fuels is alleviated by addition of an anti-haze additive comprising an hydroxylated resin acid and/or a selected metal resinate salt.

Accordingly, it is an object of this invention to provide a petroleum fuel composition which has particularly improved haze properties. It is another object of this invention to provide a method whereby the problem of haze formation in petroleum fuels, such as gasoline or jet fuel, is overcome.

In accordance with the present invention, the foregoing and other objects and advantages are accomplished with a fuel composition comprising a major amount of a petroleum hydrocarbon fuel and an effective dehazing amount of an anti-haze additive selected from the group consisting of an hydroxylated resin acid and a metal resinate salt and mixtures thereof, wherein said metal is selected from the metals of Groups II to IV, VII and VIII of the Mendeleev periodic table.

DETAILED DESCRIPTION OF THE INVENTION

In the present invention the anti-haze additives which are added to the petroleum fuel composition comprise an hydroxylated resin acid and/or a selected metal resinate. The resin acid that is used is a monocarboxylic acid having the typical formula $C_{20}H_{30}O_2$. Generally, the term "resin acid" as used throughout the specification and claims includes acids of this formula as well as acids coming under the name, abietic acid, diterpene acids, rosin and the isomers and homologues thereof. The resin acids are oftentimes found occurring naturally as for example in rosin, but also may be obtained by methods which are well known. Further information about the resin acids may be found in Kirk-Othmer, "Encyclopedia of Chemical Technology", second edition, Vol. 17, pages 475–508.

The resin acids, as defined above, are hydroxylated for use in this invention and such hydroxylation is obtained through well known oxidation routes as, for example, described in the above noted Kirk-Othmer article, pages 491–493. One particularly suitable method for hydrolyating the resin acids involves the well known permanganate oxidation technique wherein for example, an alkaline permanganate is used at temperatures generally below ambient temperature. Generally, such hydroxylated resin acids will have about 1 to about 5, preferably about 2 to about 4 and more preferably about 4 hydroxyl groups.

The metal resinate salts which optionally may be used in combination with the resin acids or along, generally comprise the metal salts of the resin acids wherein the metal is selected from the metals of Groups II to IV, VII and VIII of the Mendeleev periodic table and mixtures thereof. More particularly, the metal used in the metal resinate salt will be selected from the group consisting of zinc, calcium, magnesium, lead, manganese and iron, with zinc being the most particularly preferred. A mixture of zinc and calcium resinates has been found to be particularly suitable in the composition of this invention. Preparation of the metal resinate salts is well known as disclosed in the previously cited Kirk-Othmer article, pages 498 to 500.

A wide variety of petroleum hydrocarbon fuels can be dehazed according to this invention. In general, the fuels employed include gasoline, i.e., both motor and aviation gasolines, jet fuel and kerosene and have compositions comprising mixtures of hydrocarbons of various types including straight and branched chain paraffins, olefins, aromatics and naphthenic hydrocarbons. Such fuel components may be derived from crude oil by any of the conventional refining and blending processes, such as straight run distillation, thermal cracking, hydrocracking, catalytic cracking and various reforming processes. Typical motor and aviation motor gasolines useful in this invention are described in U.S. Pat. No. 3,707,362 issued Dec. 26, 1972 to A. Zimmerman et al.

In general, the fuel composition of this invention will contain a major proportion of the petroleum hydrocarbon fuel and an effective dehazing amount of dehazer additive comprising the hydroxylated resin acid and/or metal resinate salt. More particularly, the dehazer additive will comprise from about 1 to about 30 ppm, preferably from about 2 to about 15 ppm and more preferably from about 4 to about 10 ppm by weight of the fuel composition. When combinations of the resin acid and resinate salt are used, they will generally be used in a relative weight ratio of about 1:10 to about 10:1, preferably about 1:3 to about 3:1 and more preferably about 1:1.5 to about 1.5:1 of resin acid to metal resinate salt.

The particularly preferred resin acid is abietic acid and zinc resinate is the preferred metal resinate salt. The fuel composition in which the dehaze additive is most desirably employed is gasoline and particularly motor gasoline.

Minor amounts of other additives generally used in various fuel composition may optionally be employed in the compositions of this invention. The dehaze additive of this invention is particularly effective in fuel compositions which contain an oil soluble ashless dispersant and particularly the acylated nitrogen containing compounds as disclosed for example in U.S. Pat. No. 3,632,511 issued on Jan. 4, 1972 to C. Liao.

Having thus broadly and specifically described the present invention, it is believed that the same will become even more apparent by reference to the following examples which are included for purposes of illustration and which are in no way intended to limit the scope of the invention.

EXAMPLE I

A typical unleaded gasoline composition containing 25 ptb (pounds per thousand barrels—for gasoline 1 ptb=3.8 ppm) of a conventional dispersant which is a polyisobutenyl succinic anhydride triethylene tetramine was combined with 2 ptb of an anti-haze additive comprising a hydroxylated abietic acid. The hydroxylated abietic acid was prepared from abietic acid using a permanganate oxidation method and had a chemical content by weight of 66.4% carbon, 8.3% hydrogen and 25.3% oxygen. The gasoline used contained 75 vol. % saturates, 16 vol. % aromatics and 9 vol. % olefins with a boiling range of 28.3° to 205.6° C. (83° to 402° F.) and a total sulfur content of 300 ppm.

The prepared composition was subjected to a Waring Blender haze test wherein 450 ml. of the gasoline composition and 4.5 ml. of water bottoms was mixed for 20 seconds at a speed of 5000 rpm. Haze readings (rating of 4 is very hazy, 3 moderately hazy, 2 slightly hazy and 1 bright and clear) were taken at periodic intervals and the resulting haze readings were 4 after 1 hour, 3− after 2 hours and 1 to 1+ after 3 hours.

For comparison purposes, an identical fuel composition but without the anti-haze additive was subjected to the same test and haze readings were 4 after 1 hour, 4 after 2 hours and 4− after 3 hours.

EXAMPLE II

An unleaded gasoline composition the same as in Example I was combined with 2 ptb of zinc resinate as the anti-haze additive and subjected to the Waring Blender haze test as in Example I with resulting haze readings of 4 after 1 hour, 2 to 2+ after 2 hours and 1 after 3 hours.

EXAMPLE III

An unleaded gasoline composition, the same as in Example I, was combined with an anti-haze additive comprising 1 ptb of hydrolyated abietic acid (as in Example I) and 1 ptb of a mixed zinc/calcium resinate salt, manufactured and sold commercially by Crosby Chemical and having about 4.9–5.8 wt. % zinc and about 3 to 4 wt. % calcium. The prepared composition was then subjected to the Waring Blender haze test as in Example I and the resulting haze readings were 4− after 1 hour, 1 to 1+ after 2 hours and 1 after 3 hours.

Another composition which was identical, but contained 1.5 ptb of hydroxylated abietic acid and 0.5 ptb of the zinc/calcium resinate salt, was subjected to the Waring Blender haze test and gave haze readings of 4− after 1 hour, 1+ after 2 hours and 1 after 3 hours.

Still another composition, but containing 0.5 ptb of hydroxylated abietic acid and 1.5 ptb of the zinc/calcium resinate salt, was subjected to the Waring Blender haze test and resulting readings were 4− after 1 hour, 1+ after 2 hours and 1 after 3 hours.

EXAMPLE IV

An unleaded gasoline composition, the same as in Example I, was combined with 2 ptb of an anti-haze additive comprising the same mixed zinc/calcium resinate salt as in Example III. The prepared composition was subjected to the Waring Blender haze test and the resulting haze readings were 4 after 1 hour, 3− after 2 hours and 1 to 1+ after 3 hours.

EXAMPLE V

An unleaded gasoline composition, the same as in Example I, but containing 25 ptb of polyisobutenyl succinic anhydride-polyamine as dispersant was combined with an anti-haze additive as in Example III and comprising 1 ptb of hydroxylated abietic acid and 1 ptb of mixed zinc/calcium resinate salt. The prepared composition was then subjected to the Waring Blender haze test as in Example I with a mixing speed of 3700 rpm. The resulting haze readings were 1 after 2 hours and 1 after 3 hours. For comparison purposes, an identical fuel composition, but without the anti-haze additive, was subjected to the same test and haze readings were 4 after both 2 and 3 hours.

Another test using the same formulation containing the anti-haze additive gave haze readings of 1 to 1+ after 2 hours and 1 after 3 hours. The same fuel composition without the anti-haze additive gave haze readings of 4 after 2 hours and 3 to 3+ after 3 hours.

The above results all show the advantageous dehazing effects of compositions which contained the anti-haze additive of this invention when compared with the same compositions without such anti-haze additives. Similar reduced haze results were obtained when magnesium, lead, manganese and iron resinate salts were used as the anti-haze additive.

What is claimed is:

1. A fuel composition comprising a major amount of gasoline and from about 1 to about 30 ppm by weight of an anti-haze additive selected from the group consisting of an hydroxylated resin acid and a metal resinate salt wherein said metal is selected from the metals of Group II to IV, VII and VIII of the Mendeleev periodic table.

2. A fuel composition comprising a major amount of gasoline and an effective dehazing amount of an hydroxylated resin acid anti-haze additive.

3. The composition of claim 1 wherein the metal in said metal resinate salt is selected from the group consisting of zinc, calcium, magnesium, lead, manganese and iron.

4. The composition of claim 1 wherein said anti-haze additive is an hydroxylated resin acid which contains from about 1 to about 5 hydroxyl groups.

5. The composition of claim 3 wherein from about 2 to about 15 ppm by weight of said anti-haze additive is used.

6. The composition of claim 4 wherein said hydroxylated resin acid is hydroxylated abietic acid.

7. The composition of claim 5 wherein said anti-haze additive is an hydroxylated resin acid which contains from about 1 to about 5 hydroxyl groups.

8. The composition of claim 7 wherein said hydroxylated resin acid is hydroxylated abietic acid.

9. The composition of claim 8 wherein said hydroxylated abietic acid contains from about 2 to about 4 hydroxyl groups.

10. The composition of claim 9 which additionally contains an oil soluble ashless dispersant.

11. The composition of claim 5 wherein zinc resinate salt is said metal resinate salt.

12. The composition of claim 11 which additionally contains an oil soluble ashless dispersant.

13. The composition of claim 5 wherein said anti-haze additive is a mixture of said metal resinate salts.

14. The composition of claim 13 wherein said anti-haze additive is a mixture of zinc and calcium resinate salts.

15. The composition of claim 14 which additionally contains an oil soluble ashless dispersant.

16. The composition of claim 1 wherein said anti-haze additive comprises a mixture of said hydroxylated resin acid and said metal resinate salt in the relative weight ratio of about 1:10 to about 10:1 of resin acid to metal resinate salt.

17. The composition of claim 16 wherein the metal in said metal resinate is selected from the group consisting of zinc, calcium, magnesium, lead, manganese and iron.

18. The composition of claim 17 wherein said relative weight ratio of hydroxylated resin acid to metal resinate salt is from about 1:3 to about 3:1.

19. The composition of claim 18 wherein said hydroxylated resin acid is hydroxylated abietic acid containing from about 1 to about 5 hydroxyl groups.

20. The composition of claim 19 wherein zinc resinate salt is said metal resinate salt.

21. The composition of 19 wherein said metal resinate salt is a mixture of zinc and calcium resinate salts.

22. The composition of claim 21 wherein from about 2 to about 15 ppm by weight of said anti-haze additive is used and said fuel composition is gasoline which additionally contains an oil soluble ashless dispersant.

23. A method of removing or reducing the haze formation in gasoline comprising adding from about 1 to about 30 ppm by weight of an anti-haze additive selected from the group consisting of an hydroxylated resin acid and a metal resinate salt wherein said metal is selected from the metals of Group II to IV, VII and VIII of the Mendeleev periodic table.

24. A method of removing or reducing the haze formation in gasoline comprising adding an effective dehazing amount of an hydroxylated resin acid anti-haze additive.

25. The method of claim 23 wherein from about 1 to about 30 ppm by weight of said anti-haze additive is used and the metal in said metal resinate salt is selected from the group consisting of zine, calcium, magnesium, lead, manganese and iron.

* * * * *